US008777776B2

(12) United States Patent
Wahl et al.

(10) Patent No.: US 8,777,776 B2
(45) Date of Patent: Jul. 15, 2014

(54) GOLF CLUB HEAD HAVING A COMPOSITE FACE INSERT

(75) Inventors: Bret H. Wahl, Escondido, CA (US); Peter L. Larsen, San Marcos, CA (US); Chris Schartiger, San Diego, CA (US); Xinhui Deng, Carlsbad, CA (US); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 683 days.

(21) Appl. No.: 12/655,082

(22) Filed: Dec. 21, 2009

(65) Prior Publication Data

US 2010/0151960 A1 Jun. 17, 2010

Related U.S. Application Data

(63) Continuation-in-part of application No. 12/589,486, filed on Oct. 22, 2009, now Pat. No. 7,871,340, which is a continuation of application No. 11/895,195, filed on Aug. 21, 2007, now Pat. No. 7,628,712, which is a continuation of application No. 10/442,348, filed on May 21, 2003, now Pat. No. 7,267,620.

(51) Int. Cl.
*A63B 53/04* (2006.01)

(52) U.S. Cl.
USPC ..... 473/342; 473/345; 473/350

(58) Field of Classification Search
USPC ..... 473/324–350
See application file for complete search history.

(56) References Cited

U.S. PATENT DOCUMENTS

| | | | |
|---|---|---|---|
| 1,133,129 | A | 3/1915 | Govan |
| 3,567,228 | A | 3/1971 | Lynn |
| 3,695,618 | A | 10/1972 | Woolley et al. |
| 3,836,153 | A | 9/1974 | Dance, Jr. |
| 3,937,474 | A | 2/1976 | Jepson et al. |
| 4,398,965 | A | 8/1983 | Campau |
| 4,523,759 | A | 6/1985 | Igarashi |

(Continued)

FOREIGN PATENT DOCUMENTS

| | | |
|---|---|---|
| GB | 1 201 648 | 8/1970 |
| GB | 2 338 903 | 1/2000 |

(Continued)

OTHER PUBLICATIONS

Taylor Made '94/'95 Products—Mid Tour; Mid Tour GF.

(Continued)

*Primary Examiner* — Alvin Hunter
(74) *Attorney, Agent, or Firm* — Klarquist Sparkman, LLP

(57) ABSTRACT

A golf club head having a composite face insert attached to a metallic body is provided. The club head preferably has a volume of at least 200 cc and provides superior durability and club performance. The face insert includes prepreg plies having a fiber areal weight (FAW) of less than 100 g/m$^2$. The face insert preferably has a thickness less than 4 mm and a mass at least 10 grams less than an insert of equivalent volume formed of the metallic material of the body of the club head. A metallic cap with a peripheral rim is also provided to protect the ends of the composite material of the face insert. Related methods of manufacturing and alternative materials are disclosed. The resin content of the prepreg plies can be controlled through management of the timing and environment in which the resultant prepreg plies are cured and soaked.

18 Claims, 13 Drawing Sheets

(56) References Cited

U.S. PATENT DOCUMENTS

| | | | | | |
|---|---|---|---|---|---|
| 4,539,253 | A | | 9/1985 | Hirschbuehler et al. | |
| 4,545,580 | A | | 10/1985 | Tomita et al. | |
| 4,618,149 | A | | 10/1986 | Maxel | |
| 4,740,345 | A | | 4/1988 | Nagasaki et al. | |
| 4,792,139 | A | | 12/1988 | Nagasaki et al. | |
| 4,793,616 | A | | 12/1988 | Fernandez | |
| 4,798,383 | A | * | 1/1989 | Nagasaki et al. | 473/348 |
| 4,804,188 | A | | 2/1989 | McKee et al. | |
| 4,809,978 | A | | 3/1989 | Yamaguchi et al. | |
| 4,848,747 | A | | 7/1989 | Fujimura et al. | |
| 4,884,812 | A | * | 12/1989 | Nagasaki et al. | 473/342 |
| 4,928,972 | A | | 5/1990 | Nakanishi et al. | |
| 4,964,640 | A | | 10/1990 | Nakanishi et al. | |
| 4,995,609 | A | | 2/1991 | Parente et al. | |
| 5,007,643 | A | | 4/1991 | Okumoto et al. | |
| 5,016,882 | A | | 5/1991 | Fujimura et al. | |
| 5,057,353 | A | * | 10/1991 | Maranci et al. | 428/147 |
| 5,078,397 | A | * | 1/1992 | Aizawa | 473/342 |
| 5,104,123 | A | | 4/1992 | Okitsu et al. | |
| 5,106,094 | A | | 4/1992 | Desbiolles et al. | |
| 5,135,227 | A | | 8/1992 | Okumoto et al. | |
| 5,176,384 | A | * | 1/1993 | Sata et al. | 473/329 |
| 5,261,664 | A | | 11/1993 | Anderson | |
| 5,271,621 | A | * | 12/1993 | Lo | 473/345 |
| 5,277,423 | A | | 1/1994 | Artus | |
| 5,310,185 | A | * | 5/1994 | Viollaz et al. | 473/330 |
| 5,312,106 | A | | 5/1994 | Cook | |
| 5,344,140 | A | | 9/1994 | Anderson | |
| 5,346,216 | A | | 9/1994 | Aizawa | |
| 5,348,302 | A | | 9/1994 | Sasamoto et al. | |
| 5,377,986 | A | * | 1/1995 | Viollaz et al. | 473/330 |
| 5,417,419 | A | | 5/1995 | Anderson et al. | |
| 5,425,538 | A | * | 6/1995 | Vincent et al. | 473/342 |
| 5,433,440 | A | | 7/1995 | Lin | |
| 5,447,311 | A | * | 9/1995 | Viollaz et al. | 473/342 |
| 5,465,969 | A | | 11/1995 | Cadorniga | |
| 5,472,201 | A | * | 12/1995 | Aizawa et al. | 473/329 |
| 5,480,153 | A | | 1/1996 | Igarashi | |
| 5,494,281 | A | | 2/1996 | Chen | |
| 5,499,819 | A | | 3/1996 | Nagamoto | |
| 5,505,453 | A | | 4/1996 | Mack | |
| 5,518,242 | A | | 5/1996 | Mahaffey et al. | |
| 5,529,543 | A | | 6/1996 | Beaumont, Sr. | |
| 5,649,873 | A | | 7/1997 | Fuller | |
| 5,672,120 | A | | 9/1997 | Ramirez et al. | |
| 5,697,855 | A | | 12/1997 | Aizawa | |
| 5,720,673 | A | | 2/1998 | Anderson | |
| 5,743,813 | A | | 4/1998 | Chen et al. | |
| 5,766,092 | A | | 6/1998 | Mimeur et al. | |
| 5,774,970 | A | | 7/1998 | Huang | |
| 5,827,131 | A | | 10/1998 | Mahaffey et al. | |
| 5,830,084 | A | | 11/1998 | Kosmatka | |
| 5,906,550 | A | | 5/1999 | Kingston | |
| 5,967,903 | A | | 10/1999 | Cheng | |
| 5,985,197 | A | | 11/1999 | Nelson et al. | |
| 5,993,329 | A | | 11/1999 | Shieh | |
| 6,050,904 | A | | 4/2000 | Kuo | |
| 6,071,200 | A | | 6/2000 | Song | |
| 6,162,133 | A | | 12/2000 | Peterson | |
| 6,165,081 | A | | 12/2000 | Chou | |
| 6,193,614 | B1 | | 2/2001 | Sasamoto et al. | |
| 6,248,024 | B1 | | 6/2001 | Nelson et al. | |
| 6,248,025 | B1 | | 6/2001 | Murphy et al. | |
| 6,299,547 | B1 | | 10/2001 | Kosmatka | |
| 6,306,048 | B1 | | 10/2001 | McCabe et al. | |
| 6,338,683 | B1 | | 1/2002 | Kosmatka | |
| 6,354,962 | B1 | * | 3/2002 | Galloway et al. | 473/342 |
| 6,364,789 | B1 | * | 4/2002 | Kosmatka | 473/329 |
| 6,368,234 | B1 | * | 4/2002 | Galloway | 473/349 |
| 6,390,932 | B1 | | 5/2002 | Kosmatka et al. | |
| 6,406,378 | B1 | | 6/2002 | Murphy et al. | |
| 6,406,381 | B2 | | 6/2002 | Murphy et al. | |
| 6,435,980 | B1 | | 8/2002 | Reyes et al. | |
| 6,440,008 | B2 | | 8/2002 | Murphy et al. | |
| 6,440,011 | B1 | | 8/2002 | Hocknell et al. | |
| 6,582,323 | B2 | | 6/2003 | Soracco et al. | |
| 6,607,451 | B2 | | 8/2003 | Kosmatka et al. | |
| 6,648,774 | B1 | | 11/2003 | Lee | |
| 6,669,576 | B1 | | 12/2003 | Rice | |
| 6,669,577 | B1 | | 12/2003 | Hocknell et al. | |
| 6,743,117 | B2 | | 6/2004 | Gilbert | |
| 6,835,144 | B2 | | 12/2004 | Best | |
| 6,918,840 | B2 | | 7/2005 | Stites et al. | |
| 6,921,343 | B2 | | 7/2005 | Solheim | |
| 6,921,344 | B2 | | 7/2005 | Gilbert et al. | |
| 6,923,732 | B2 | | 8/2005 | Stites et al. | |
| 6,991,559 | B2 | | 1/2006 | Yabu | |
| 7,004,852 | B2 | | 2/2006 | Billings | |
| 7,022,029 | B2 | | 4/2006 | Caldwell | |
| 7,140,974 | B2 | | 11/2006 | Chao et al. | |
| 7,147,571 | B2 | | 12/2006 | Best et al. | |
| 7,189,165 | B2 | | 3/2007 | Yamamoto | |
| 7,207,899 | B2 | | 4/2007 | Imamoto | |
| 7,232,377 | B2 | | 6/2007 | Gilbert et al. | |
| 7,261,930 | B2 | * | 8/2007 | Ellis | 428/114 |
| 7,267,620 | B2 | * | 9/2007 | Chao et al. | 473/342 |
| 7,300,361 | B2 | | 11/2007 | Stites et al. | |
| 7,303,486 | B2 | | 12/2007 | Imamoto | |
| 7,316,623 | B2 | | 1/2008 | Imamoto | |
| 7,357,730 | B2 | | 4/2008 | Shieh | |
| 7,476,162 | B2 | | 1/2009 | Stites et al. | |
| 7,481,719 | B2 | | 1/2009 | Imamoto | |
| 7,628,712 | B2 | * | 12/2009 | Chao et al. | 473/342 |
| 7,850,546 | B2 | * | 12/2010 | Chao et al. | 473/342 |
| 7,862,452 | B2 | * | 1/2011 | Chao et al. | 473/342 |
| 7,874,936 | B2 | * | 1/2011 | Chao | 473/342 |
| 7,874,937 | B2 | * | 1/2011 | Chao | 473/342 |
| 7,874,938 | B2 | * | 1/2011 | Chao | 473/342 |
| 8,163,119 | B2 | * | 4/2012 | Chao | 156/245 |
| 2001/0055995 | A1 | | 12/2001 | Cackett et al. | |
| 2002/0065146 | A1 | | 5/2002 | Kusumoto | |
| 2002/0169034 | A1 | | 11/2002 | Hocknell et al. | |
| 2003/0036442 | A1 | | 2/2003 | Chao et al. | |
| 2003/0139227 | A1 | | 7/2003 | Sugimoto | |
| 2005/0026718 | A1 | | 2/2005 | Chen | |
| 2005/0075191 | A1 | | 4/2005 | Bennett | |
| 2007/0049417 | A1 | | 3/2007 | Shear | |
| 2007/0129162 | A1 | | 6/2007 | Pan et al. | |
| 2007/0129166 | A1 | | 6/2007 | Shimazaki et al. | |
| 2007/0155533 | A1 | | 7/2007 | Solheim et al. | |
| 2007/0293349 | A1 | | 12/2007 | Chao et al. | |
| 2008/0004134 | A1 | | 1/2008 | Roach et al. | |
| 2008/0032813 | A1 | | 2/2008 | Hagood et al. | |
| 2008/0032815 | A1 | | 2/2008 | Yamamoto | |
| 2008/0058117 | A1 | | 3/2008 | Roach | |
| 2009/0005191 | A1 | * | 1/2009 | Lin | 473/331 |

FOREIGN PATENT DOCUMENTS

| | | | | |
|---|---|---|---|---|
| JP | 60-15145 | | | 1/1985 |
| JP | 01-171583 | A | | 7/1989 |
| JP | 4109973 | | | 4/1992 |
| JP | 05-007261 | | | 2/1993 |
| JP | U-H05-068564 | | | 9/1993 |
| JP | 6-23071 | | | 2/1994 |
| JP | 6079023 | | | 3/1994 |
| JP | 6503490 | | | 4/1994 |
| JP | 06-165842 | | | 6/1994 |
| JP | 6-205858 | | | 7/1994 |
| JP | 07-001958 | | | 1/1995 |
| JP | 08257177 | A | * | 10/1996 |
| JP | 9117537 | | | 5/1997 |
| JP | 09-176347 | | | 7/1997 |
| JP | 09-299519 | | | 11/1997 |
| JP | 10-155943 | | | 6/1998 |
| JP | 11-137734 | | | 5/1999 |
| JP | 11-347155 | | | 12/1999 |
| JP | 2001-293112 | | | 10/2001 |
| JP | 2001316971 | | | 11/2001 |
| JP | 2002315854 | | | 10/2002 |
| JP | 2002-331051 | | | 11/2002 |

(56) References Cited

FOREIGN PATENT DOCUMENTS

| | | |
|---|---|---|
| JP | 2003-024483 | 1/2003 |
| JP | 2003-144590 | 5/2003 |
| JP | 2003138041 | 5/2003 |
| JP | T-2003-518993 | 6/2003 |
| JP | 2005-218510 | 8/2005 |
| JP | 2006-167033 | 6/2006 |
| WO | WO2006/017605 | 2/2006 |

OTHER PUBLICATIONS

English Translation of the Appeal Board's Questioning, Japanese Application No. 2004-150575, Appeal No. 2008-15208, 4pp. (Nov. 20, 1009).

Japanese Office action (English translation), Japanese App. No. 2005-123040, filed Apr. 21, 2005, 3pp. (Aug. 3, 2010).

* cited by examiner

GOLF CLUB HEAD HAVING A COMPOSITE FACE INSERT

CROSS REFERENCE TO RELATED APPLICATION

This application is a continuation-in-part of U.S. patent application Ser. No. 12/589,486, filed Oct. 22, 2009 now U.S. Pat. No. 7,871,340, which is a continuation of U.S. patent application Ser. No. 11/895,195, filed Aug. 21, 2007 (now U.S. Pat. No. 7,628,712), which is a continuation of U.S. patent application Ser. No. 10/442,348, filed May 21, 2003 (now U.S. Pat. No. 7,267,620), which are hereby incorporated herein by reference.

BACKGROUND

The present invention relates generally to golf club heads and, more particularly, to a wood-type golf club head having a composite face insert.

Composite materials have long been recognized for combining many beneficial attributes of various types and are commonly used in golf club heads. Composite materials typically are less dense than other materials used in golf clubs. Thus, the use of composite materials allows for more leeway in how weight is distributed about the club. It is often desirable to locate club weight away from the striking face. Thus, attempts have been made to incorporate composite materials in the club face.

Although such attempts have been generally effective for weight reduction purposes, a number of shortfalls remain, such as durability, impact resistance and overall club performance. For example, prior composite club faces have often suffered from delamination, or peeling apart, of composite layers, greatly reducing the useable life of the club. Delamination is particularly a problem at interface regions between the composite material and other materials of the club head. Such problems have arisen even at relatively low impact levels, hit counts and in benign playing conditions. Attempts to resolve such problems often fail to provide satisfactory club performance, measured by factors such as coefficient of restitution (COR), particularly for wood-type club heads having a volume of at least 300 cc. It should, therefore, be appreciated that there exists a need for a wood-type golf club head having composite material at the club face that is durable, can endure high level impacts and yet provide superior club performance. The present invention fulfills this need and others.

It should, therefore, be appreciated that there exists a need for a wood-type golf club head and an iron-type golf club head having composite material at the club face that is durable, can endure high level impacts and yet provide superior club performance. The present invention fulfills this need and others.

SUMMARY

The invention provides a golf club head having a lightweight face insert attached to a body that is at least partly formed of a metallic material, providing superior durability and club performance. To that end, the face insert comprises prepreg plies having a fiber areal weight (FAW) of less than 100 g/m$^2$. The body preferably forms a volume of at least 200 cc. The face insert preferably has a thickness less than 4 mm and has a mass at least 10 grams less than an insert of equivalent volume formed of the metallic material of the body of the club head. The coefficient of restitution for the club head, measured in accordance to the United States Golf Association Rule 4-1a, is at least 0.79.

In a preferred embodiment of the invention, the face insert further includes a cap with a peripheral rim that is attached to a front surface of the composite region. Also preferably, the thickness of the composite region is about 4.5 mm or less and the metallic cap thickness is about 0.5 mm or less; more preferably the thickness of the composite region is about 3.5 mm or less and the metallic cap thickness is about 0.3 mm or less. The cap preferably comprises a titanium alloy. The face insert may alternatively comprise a layer of textured film co-cured with the plies of low FAW material, in which the layer of textured film forms a front surface of the face insert instead of the metallic cap. The layer of textured film preferably comprises nylon fabric. Without the metallic cap, the mass of the face insert is at least 15 grams less than an insert of equivalent volume formed of the metallic material of the body of the club head.

A preferred method of the present invention advantageously controls the resin content of the low fiber areal weight (FAW) composite material of the golf club face. The steps comprise:

- stacking and cutting a plurality of prepreg plies having a fiber areal weight (FAW) of less than 100 g/m$^2$ to form an uncured face insert having substantially a final desired shape, bulge and roll;
- placing the uncured face insert into a tool with an initial temperature $T_1$;
- curing the uncured face insert for about 5 minutes at a first pressure $P_1$ then initiating heating the tool to a set temperature $T_2$ greater than or equal to the initial temperature $T_1$ and curing another 15 minutes at a second pressure $P_2$ greater than the first pressure $P_1$, thus obtaining the cured face insert;
- continue forming the cured face insert at the set temperature and second pressure $P_2$ for about 30 minutes; and
- soaking the cured face insert for 5 minutes at a third pressure $P_3$ less than the second pressure $P_2$, such that the desired resin content is achieved.

Alternatively, the tool temperature may be immediately raised to a set temperature $T_2$ upon placement of the composite material therein, this temperature being held substantially constant over the soaking and curing phases. After an initial soaking time of about 5 minutes, the pressure is raised from a first pressure $P_1$ to a second pressure $P_2$ greater than the first pressure $P_1$. After an additional time of about 15 minutes, the pressure is reduced to about the same value as the first pressure for about another 20 minutes.

For purposes of summarizing the invention and the advantages achieved over the prior art, certain advantages of the invention have been described above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

In one aspect of the present invention, an iron-type golf club a body having a heel portion, a sole portion, a toe portion, a top-line portion, a front portion, a rear portion, and a striking face is described. A cavity is defined by at least a rear surface of the striking face, an interior rear wall surface, and the sole portion. A composite face insert comprising prepreg plies having a fiber areal weight of less than 200 g/m$^2$ is also described. The face insert is attached at the front opening of the body and enclosing the front opening of the body. The thickness of the prepreg plies is within a range of about 1 mm to about 8 mm.

In another aspect of the present invention, an iron-type golf club body having a heel portion, a sole portion, a toe portion, a top-line portion, a front portion, a rear portion, and a striking face. A cavity is described that is defined by at least a rear surface of the striking face, an interior rear wall surface, and the sole portion. A composite face insert is described including prepreg plies having a fiber areal weight less than 100 $g/m^2$. The face insert is attached at the front opening of the body and enclosing the front opening of the body. The thickness of the prepreg plies is within a range of about 1 mm to about 8 mm. The golf club head having a coefficient of restitution of at least 0.79.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION

Figure 1:
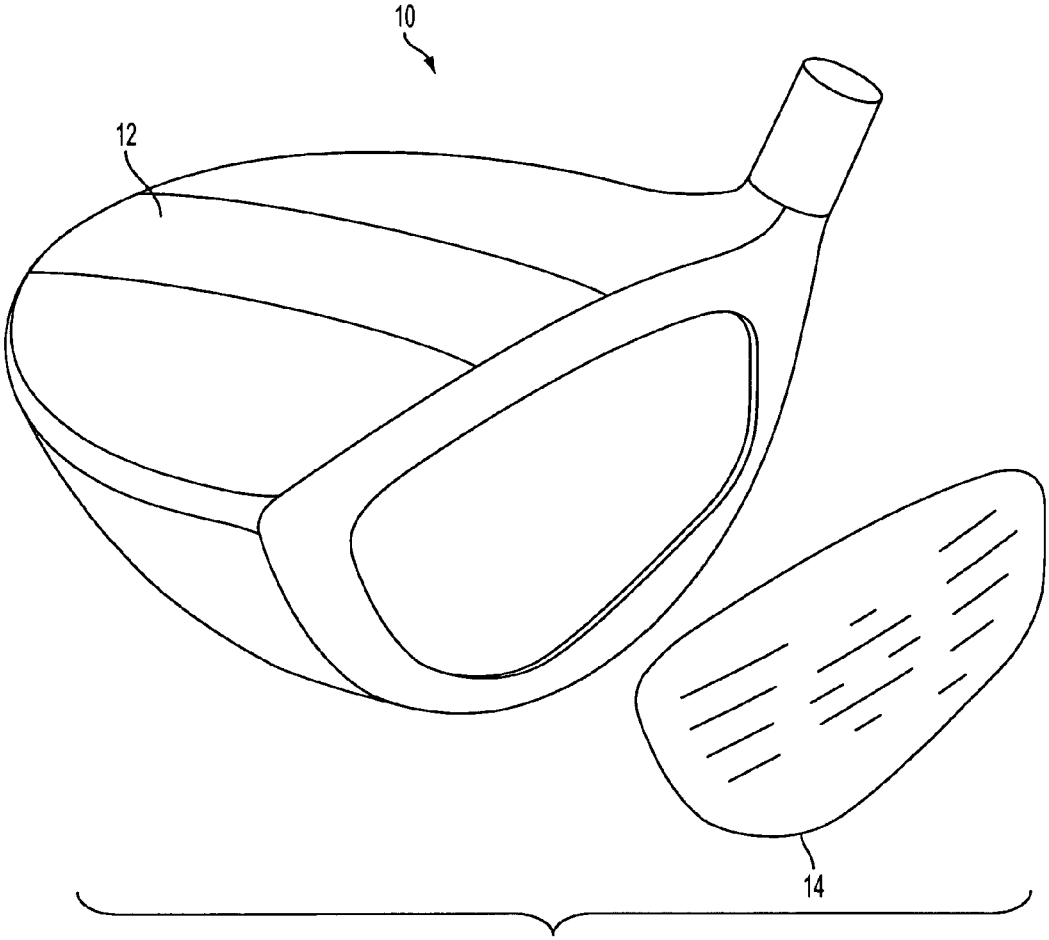
FIG. 1 is an exploded view of a club head in accordance with the invention, depicting a composite face insert and a metallic body.
Figure 2:
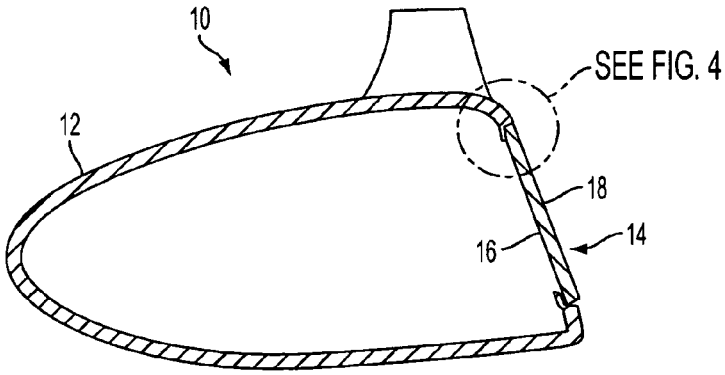
FIG. 2 is a cross-sectional view of the club head of FIG. 1.

With reference to the illustrative drawings, and particularly FIGS. 1 and 2, there is shown a golf club head 10 having a metallic body 12 and a face insert 14 comprising a composite region 16 and a metallic cap 18. The face insert 14 is durable and yet lightweight. As a result, weight can be allocated to other areas of the club head 10, enabling the club head's center of gravity to be desirably located farther from the striking face 40 and to further enhance the club head's moment of inertia. The body 12 includes an annular ledge 32 for supporting the face insert 14. In a preferred embodiment, the body 12 is formed by investment casting a titanium alloy. With the face insert 14 in place, the club head 10 preferably defines a volume of at least 200 cc and more preferably a volume of at least 300 cc. The club head 10 has superior durability and club performance, including a coefficient of restitution (COR) of at least 0.79.

Figure 3:
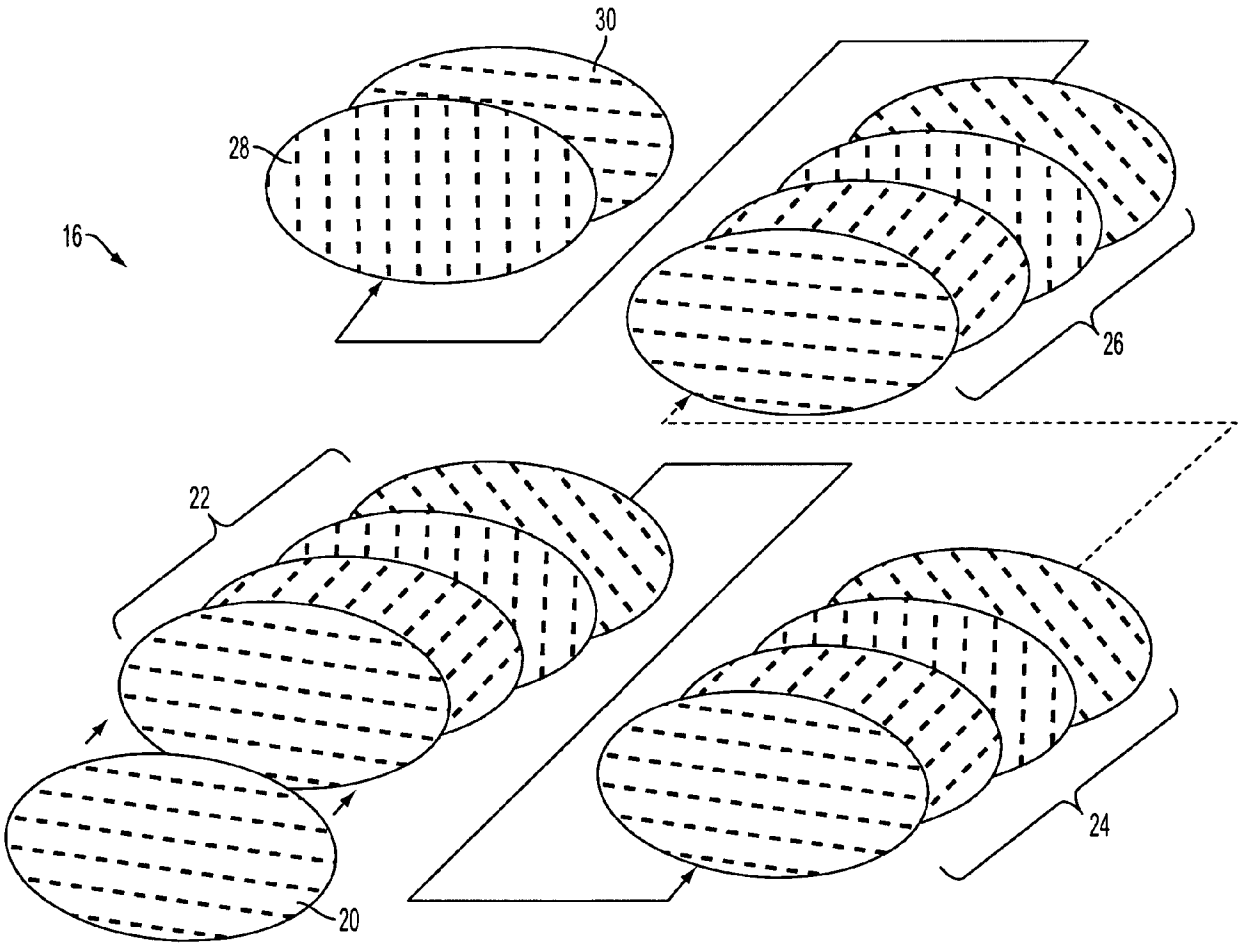
FIG. 3 is an exploded view of the composite region of the face insert of FIG. 1 showing the plies comprising the composite region.

With reference to FIG. 3, the composite region 16 of the face insert 14 is configured to have a relatively consistent distribution of reinforcement fibers across a cross section of its thickness to facilitate efficient distribution of impact forces and overall durability. The composite region 16 includes prepreg plies, each ply having a fiber reinforcement and a resin matrix selected to contribute to the club's durability and overall performance. Tests have demonstrated that composite regions formed of prepreg plies having a relatively low fiber areal weight (FAW) provide superior attributes in several areas, such as, impact resistance, durability and overall club performance. More particularly, FAW values below 100 $g/m^2$, or preferably 70 $g/m^2$ or more preferably 50 $g/m^2$, are considered to be particularly effective. Several prepreg plies having a low FAW can be stacked and still have a relatively uniform distribution of fiber across the thickness of the stacked plies. In contrast, at comparable resin content (R/C) levels, stacked plies of prepreg materials having a higher FAW tend to have more significant resin rich regions, particularly at the interfaces of adjacent plies, than stacked plies of lower FAW materials. It is believed that resin rich regions tend to inhibit the efficacy of the fiber reinforcement, particularly since the force resulting from golf ball impact is generally transverse to the orientation of the fibers of the fiber reinforcement. Preferred methods of manufacturing, which aid in reducing resin rich regions, are discussed in detail further below.

Due to the efficiency of prepreg plies of low FAW, the face insert 14 can be relatively thin, preferably less than about 4.5 mm and more preferably less than about 3.5 mm. Thus, use of the face insert 14 results in weight savings of about 10 g to 15 g over a comparable volume of metal used in the body 12 (e.g., Ti-6Al-4V). As mentioned above, this weight can be allocated to other areas of the club, as desired. Moreover, the club head 10 has demonstrated both superior durability and performance. In a durability test, the club head 10 survived over 3000 impacts of a golf ball shot at a velocity of about 44 m/sec. In a performance test of the club's COR, measured in accordance with the United States Golf Association Rule 4-1a, the club head had a COR of about 0.828.

With continued reference to FIG. 3, each prepreg ply of the composite region 16 preferably has a quasi-isotropic fiber reinforcement, and the plies are stacked in a prescribed order and orientation. For convenience of reference, the orientation of the plies is measured from a horizontal axis of the club head's face plane to a line aligned with the fiber orientation of each ply. A first ply 20 of the composite region 16 is oriented at 0 degrees, followed by ten to twelve groups of plies (22, 24, 26) each having four plies oriented at 0, +45, 90 and −45 degrees, respectively. Thereafter, a ply 28 oriented at 90 degrees precedes the final or innermost ply 30 oriented at 0 degrees. In this embodiment, the first and final plies are formed of a prepreg material reinforced by glass fibers, such as 1080 glass fibers. The remaining plies are formed of prepreg material reinforced by carbon fiber.

A suitable carbon fiber reinforcement comprises a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Suitable epoxy resins known as Newport 301 and 350 are available from Newport Adhesives & Composites, Inc., of Irvine, Calif.

In a preferred embodiment, the composite region 16 includes prepreg sheets having a quasi-isotropic fiber reinforcement of 34-700 fiber having an areal weight of about 70 g/m$^2$ and impregnated with an epoxy resin (e.g., Newport 301) resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%. In a durability test, several plies of this material were configured in a composite region 16 having a thickness of about 3.7 mm. The resulting composite region 16 survived over 3000 impacts of a golf ball shot at a velocity of about 44 m/sec. In another preferred embodiment, the composite region 16 comprises prepreg plies of 50 FAW TR50S/350. This material was tested in a composite region 16 having a thickness of about 3.7 mm and it too survived a similar durability test.

Figure 4:
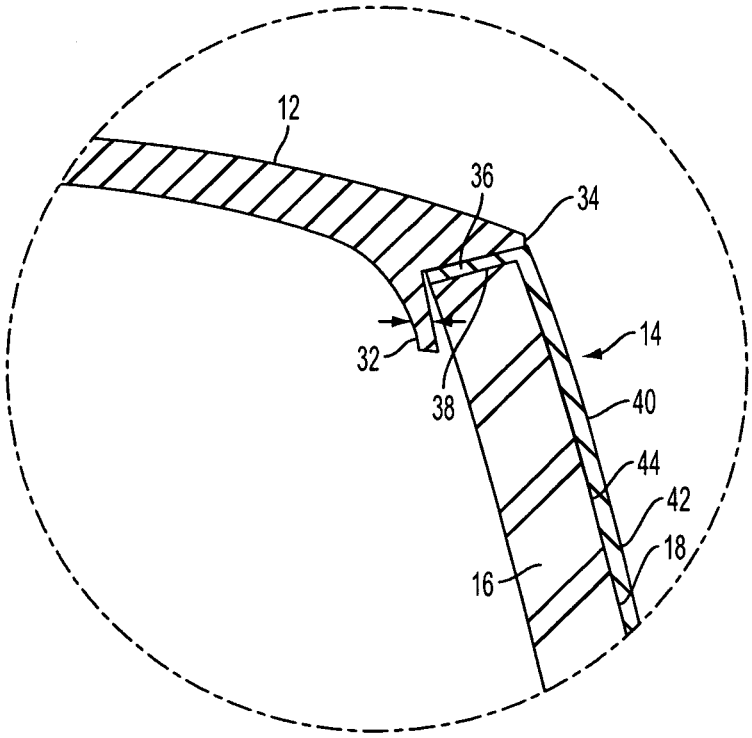
FIG. 4 is a close-up view of area A-A of the club head of FIG. 2, depicting a junction of the composite face insert and the body portion.

With reference to FIG. 4, the face insert 14 has sufficient structural strength that excessive reinforcement along the interface of the body 12 and the face insert 14 is not required, which further enhances beneficial weight allocation effects. In this embodiment, the body 12 is formed of a titanium alloy, Ti-6Al-4V; however, other suitable material can be used. The face insert 14 is supported by an annular ledge 32 and is secured preferably with an adhesive. The annular ledge 32 preferably has a thickness of about 1.5 mm and extends inwardly between about 3 mm to about 6 mm. The annular ledge 32 is sufficiently recessed to allow the face insert 14 to sit generally flush with a transition edge 34 of the body. Although, in this embodiment, the annular ledge 32 extends around the periphery of the front opening, it will be appreciated that other embodiments can utilize a plurality of spaced annular ledges, e.g., a plurality of tabs, to support the face insert 14.

With continued reference to FIG. 4, the metallic cap 18 of the face insert 14 includes a rim 36 about the periphery of the composite region 16. In a preferred embodiment, the metallic cap 18 may be attached to a front surface of the face insert 14, wherein the combined thickness of the prepreg plies of the face insert 14 and the metallic cap 18 are no greater than the depth D of the annular ledge 32 at the front opening of the body 12. The rim 36 covers a side edge 38 of the composite region 16 to further protect against peeling and delamination of the plies. Preferably, the rim 36 has a height substantially the same as the thickness of the face insert 14. In an alternative embodiment, the rim 36 may comprise a series of segments instead of a continuous cover over the side edge 38 of the composite region 16. The metallic cap 18 and rim 36 may be formed, for example, by stamping or other methods known to those skilled in the art. A preferred thickness of the metallic cap 18 is less than about 0.5 mm, and more preferably, it is less than about 0.3 mm. However, in embodiments having a face insert 14 without a metallic cap 18, weight savings of about 15 g can be realized.

Preferably, the thickness of the composite region 16 is about 4.5 mm or less and the thickness of the metallic cap 18 is about 0.5 mm or less. More preferably the thickness of the composite region 16 is about 3.5 mm or less and the thickness of the metallic cap 18 is about 0.3 mm or less. The metallic cap preferably comprises a titanium alloy.

Composite Material Process

The metallic cap 18 defines a striking face 40 having a plurality of grooves 42. The metallic cap 18 further aids in resisting wear from repeated impacts with golf balls even when covered with sand. Preferably, a bond gap 44 of about 0.05 mm to 0.2 mm, and more preferably about 0.1 mm, is provided for adhesive attachment of the metallic cap 18 to the composite region 16. In an alternative embodiment, the bond gap 44 may be no greater than 0.2 mm. The metallic cap 18 is preferably formed of Ti-6Al-4V titanium alloy; however, other titanium alloys or other materials having suitable characteristics can be employed. For example, a non-metallic cap, such as a cap comprising injection-molded plastic, having a density less than 5 g/cc and a hardness value of 80 Shore D may be employed.

As mentioned above, it is beneficial to have a composite region 16 that is relatively free of resin rich regions. To that end, fiber reinforcement sheets are impregnated with a controlled amount of resin to achieve a prescribed resin content. This is realized, in part, through management of the timing and environment in which the fiber sheets are cured and soaked.

The plies can be cut at least twice before achieving the desired dimensions. A preferred approach includes cutting plies to a first size, debulking the plies in two compression steps of about two minutes each. Thereafter, the plies are die cut to the desired shape, and compressed a third time; this time using a panel conformed to the desired bulge and roll. The plies are then stacked to a final thickness and compressed a fourth time with the conformed panel for about three minutes. The weight and thickness are measured preferably prior to the curing step.

The plies can be cut at least twice before achieving the desired dimensions. A preferred approach includes cutting plies to a first size and debulking the plies in two compression steps of about two minutes each. Thereafter, the plies are die cut to the desired shape, and compressed a third time using a panel conformed to the desired bulge and roll. The plies are then stacked to a final thickness and compressed a fourth time with the conformed panel for about three minutes. The weight and thickness of the plies are measured preferably prior to the curing step.

Figure 5:
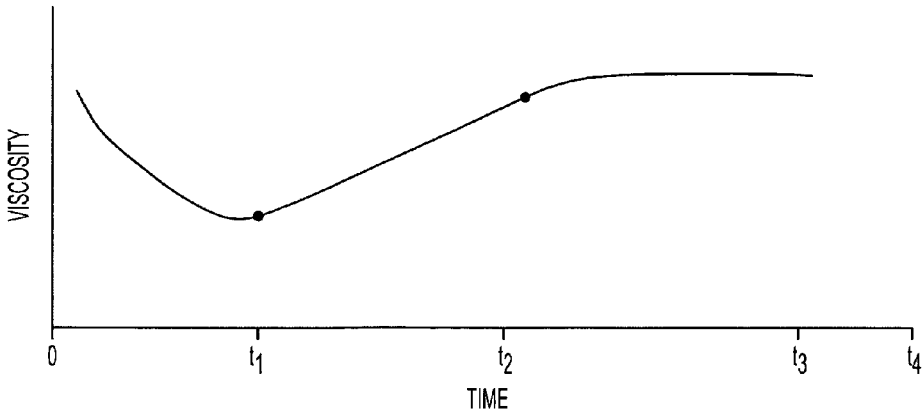
FIG. 5 is a graph depicting resin viscosity over time during the soaking and curing phases for a preferred method of forming the composite portion of the face insert of FIG. 1.
Figure 6:
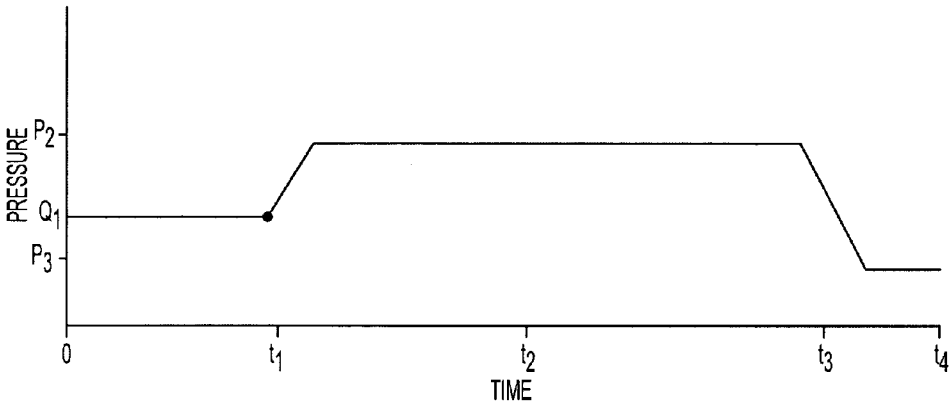
FIG. 6 is a graph depicting pressure over time during the soaking and curing phases of forming the composite portion of the face insert, corresponding to FIG. 5.
Figure 7:
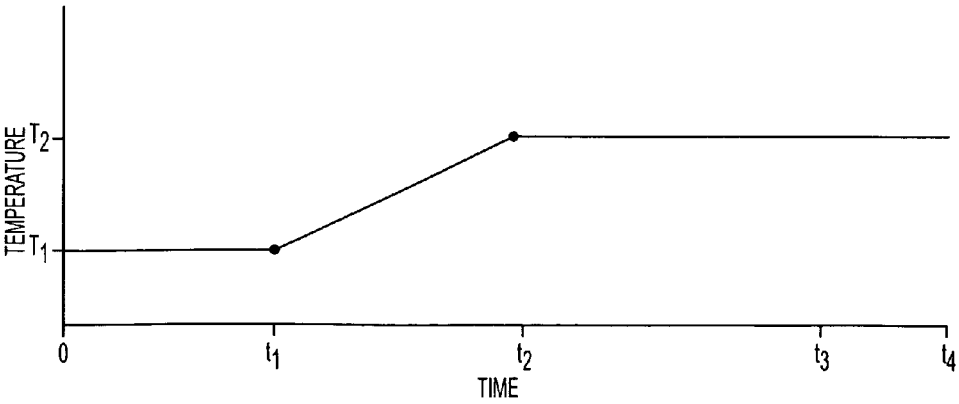
FIG. 7 is a graph depicting temperature over time during the soaking and curing phases of forming the composite portion of the insert, corresponding to FIG. 5.

FIGS. 5-7 depict an effective soaking and curing profile for impregnating plies 70 FAW 34/700 fiber sheet with Newport 301 resin. Soaking and curing occurs in a tool having upper and lower plates. The tool is pre-layered with a mold release to facilitate removal of the composite material and is preheated to an initial temperature ($T_1$) of about 200° F. The initial soak period is for about 5 minutes, from $t_0$ to $t_1$. During the soak phase, the temperature and pressure remain relatively constant. The pressure ($P_1$) is at about 15 psi.

Figure 8:
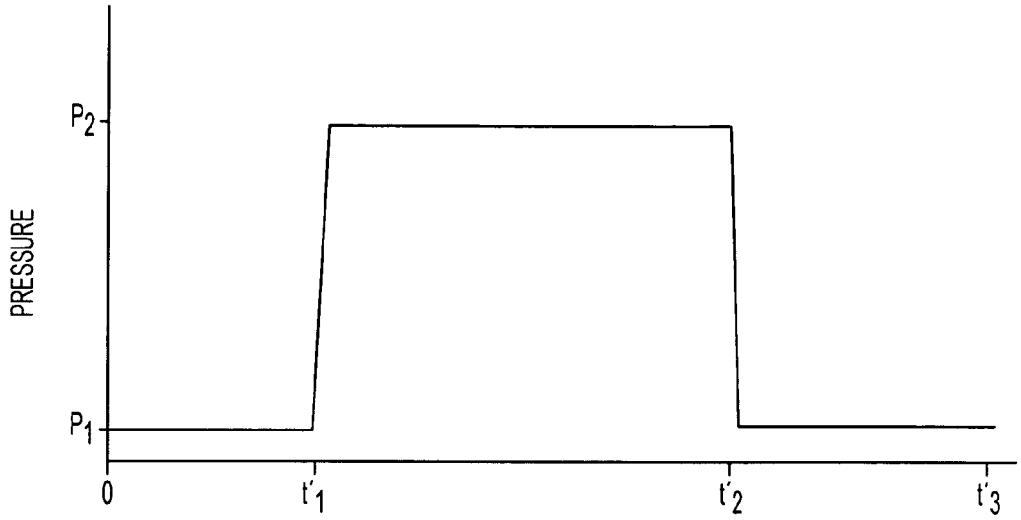
FIG. 8 is a graph depicting pressure over time during the soaking and curing phases of an alternative method of forming the composite portion of the insert of FIG. 1.
Figure 9:
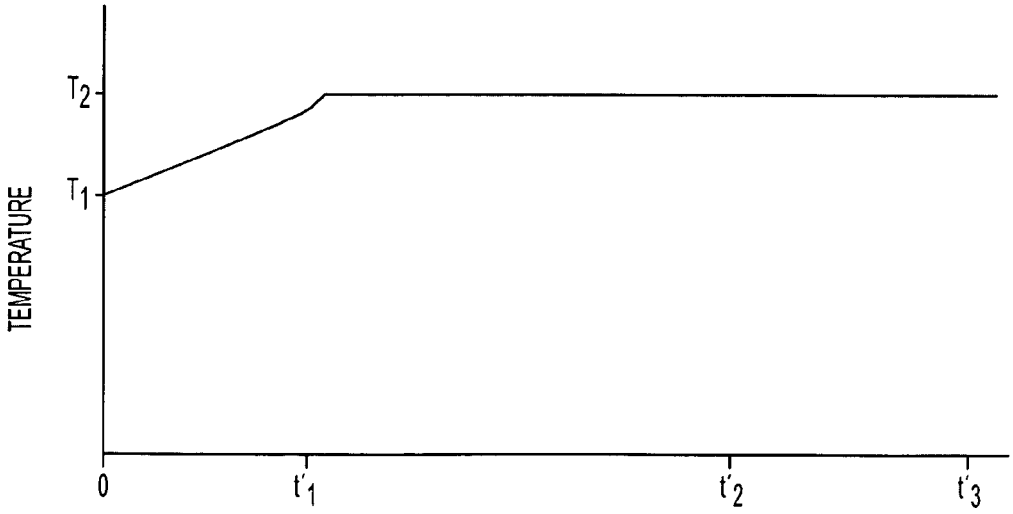
FIG. 9 is a graph depicting temperature over time during the soaking and curing phases of forming the composite portion of the insert, corresponding to FIG. 8.

An alternative soaking and curing profile is depicted in FIGS. 8 and 9. In this process, the temperature of the tool is initially about 200° F. ($T_1$) and upon placement of the composite material into the tool, the temperature is increased to about 270° F. ($T_2$). The temperature is then kept constant. The initial pressure ($P_1$) is about 20 psi. The initial soak period is for about 5 minutes, from $t_0$ (0 sec.) to $t'_1$. The pressure is then ramped up to about 200 psi ($P_2$). The post cure phase lasts about 15 minutes ($t'_1$ to $t'_2$) and a final soaking/curing cycle is performed at a pressure ($P_1$) of 20 psi for 20 minutes ($t'_2$ to $t'_3$).

Composite Face Roughness Treatment

In order to increase the surface roughness of the composite golf club face and to enhance bonding of adhesives used therewith, a layer of textured film can be placed on the material before curing. An example of the textured film is ordinary nylon fabric. Curing conditions do not degrade the fabric and an imprint of the fabric texture is transferred to the composite surface. Tests have shown that adhesion of urethane and epoxy, such as 3M® DP460, to the treated composite surface was greatly improved and superior to adhesion to a metallic surface, such as cast titanium alloy.

In order to increase the surface roughness of the composite region 16 and to enhance bonding of adhesives used therewith, a layer of textured film can be placed on the composite material before curing. An example of the textured film is ordinary nylon fabric. Curing conditions do not degrade the fabric and an imprint of the fabric texture is transferred to the composite surface. Tests have shown that adhesion of urethane and epoxy, such as 3M® DP460, to a composite surface treated in such a fashion was greatly improved and superior to adhesion to a metallic surface, such as cast titanium alloy.

A face insert 14 having increased surface roughness may comprise a layer of textured film co-cured with the plies of low FAW material, in which the layer of textured film forms a front surface of the face insert 14 instead of the metallic cap 18. The layer of textured film preferably comprises nylon fabric. Without the metallic cap 18, the mass of the face insert 14 is at least 15 grams less than a face insert of equivalent volume formed of the metallic material of the body 12 of the club head 10.

Typically, adhesion of the 3M® DP460 adhesive to a cast metallic surface is greater than to an untreated composite surface. Consequently, when the face structure fails on impact, the adhesive peels off the composite surface but remains bonded to the metallic surface. After treating a composite surface as described above, the situation is reversed [–] and the 3M® DP460 peels off the metallic surface but remains bonded to the composite surface.

The enhanced adhesion properties of this treatment contribute to an improved fatigue life for a composite golf club face. In a test, a club head having an untreated face insert 14 and a COR of about 0.847 endured about 250 test shots before significant degradation or failure occurred. In contrast, a similar club head having a treated face insert 14 and a COR of about 0.842 endured over 2000 shots before significant degradation or failure occurred.

Alternatively, the means for applying the composite texture improvement may be incorporated into the mold surface. By doing so, the textured area can be more precisely controlled. For simple face plate joining to the opening of a cast body, the texture can be formed in surfaces where shear and peel are the dominant modes of failure.

It should be appreciated from the foregoing that the present invention provides a club head 10 having a composite face insert 14 attached to a metallic body 12, forming a volume of at least 200 cc and providing superior durability and club performance. To that end, the face insert 14 comprises prepreg plies having a fiber areal weight (FAW) of less than 100 g/m$^2$. The face insert 14 preferably has a thickness less than 5 mm and has a mass at least 10 grams less than a face insert of equivalent volume formed of the metallic material of the body 12 of the club head 10. The coefficient of restitution for the club head 10 is preferably at least 0.79.

Alternatively, the face insert 14 may comprise any non-metallic material having a density less than a metallic material of the body 12 along with a metallic cap 18 covering a front surface of the face insert 14 and having a rim 36. For example, the face insert 14 of the present invention may comprise a composite material, such as a fiber-reinforced plastic or a chopped-fiber compound (e.g., bulk molded compound or sheet molded compound), or an injection-molded polymer either alone or in combination with prepreg plies having low FAW. The thickness of the face insert 14 may be substantially constant or it may comprise a variation of at least two thicknesses, one being measured at a geometric center and another measured near a periphery of the face insert 14. In one embodiment, for example, an injection-molded polymer disk may be embedded in a central region of a plurality of low FAW prepreg plies. The total thickness of the face insert 14 may range between about 1 mm and about 8 mm, and preferably between about 2 mm and about 7 mm, more preferably between about 2.5 mm and about 4 mm, and most preferably between about 3 mm and about 4 mm.

In addition, the body 12 of a club head 10 in the present invention may be formed of a metallic material, a non-metallic material or a combination of materials, such as a steel skirt and sole with a composite crown, for example. Also, one or more weights may be located in or on the body 12, as desired, to achieve final performance characteristics for the club head 10.

Figure 10A:
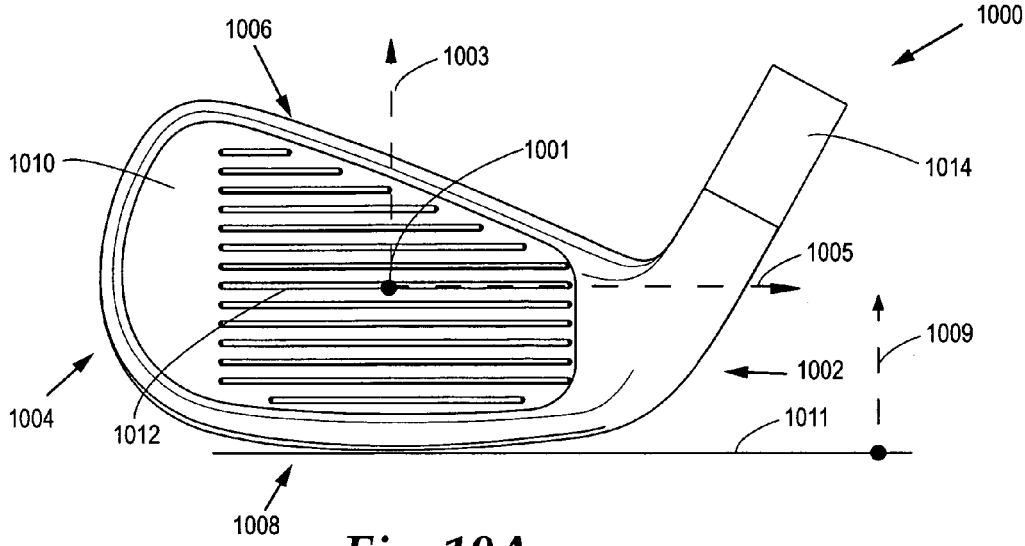
FIG. 10A illustrates a front view of an embodiment of a golf club head in an address position.

FIG. 10A illustrates a hollow iron golf club head 1000 including a heel 1002, toe 1004, sole portion 1008, and top line portion 1006. The striking face 1010 includes scoreline grooves 1012 that are designed for impact with the golf ball. The scorelines described in the embodiments herein can be molded into a composite face insert. In some embodiments, the golf club head 1000 body can be a single unitary cast piece that is adhesively attached to a striking face 1010 that is formed separately. In certain embodiments, the striking face 1010 is a composite insert as will be described in further detail below.

Figure 10B:
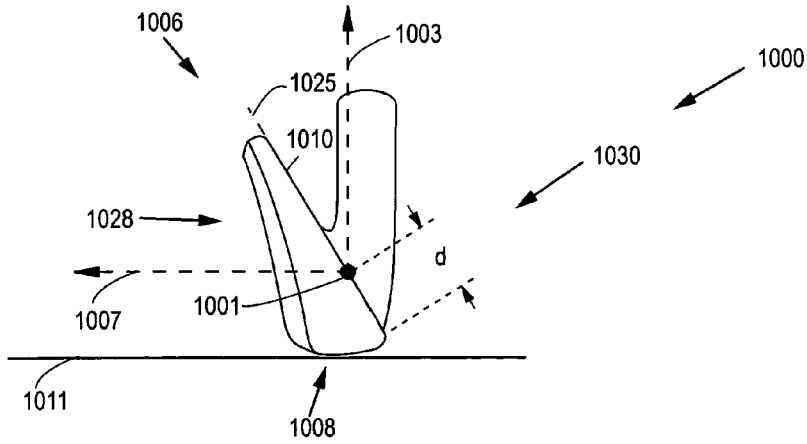
FIG. 10B illustrates a toe-side view of the golf club head shown in FIG. 10A.

FIGS. 10A and 10B also show a center point 1001 being an ideal striking point in the center of the striking face 1010 and respective orthogonal center of gravity (hereinafter, "CG") axes. A CG x-axis 1005, CG y-axis 1007, and CG z-axis 1003 intersect at the center point 1001. In addition, a CG z-up axis 1009 is defined as an axis perpendicular to the ground plane 1011 and having an origin at the ground plane 1011. The ground plane 1011 is assumed to be a perfectly flat plane.

In certain embodiments, a desirable CG-x location is between about 5 mm (heel side) and about −5 mm (toe side) along the CG x-axis 1005. A desirable CG-y location is between about 5 mm to about 20 mm along the CG y-axis 1007 toward the rear portion of the club head. Additionally, a desirable CG-z location is between about 12 mm to about 25 mm along the CG z-up axis 1009, as previously described.

FIG. 10B illustrates an elevated toe view of the golf club head 1000 including a back portion 1028, a front portion 1030, a sole portion 1008, a top line portion 1006, and a striking face 1010, as previously described. The front surface of the striking face 1010 is contained within a face plane 1025.

Figure 11:
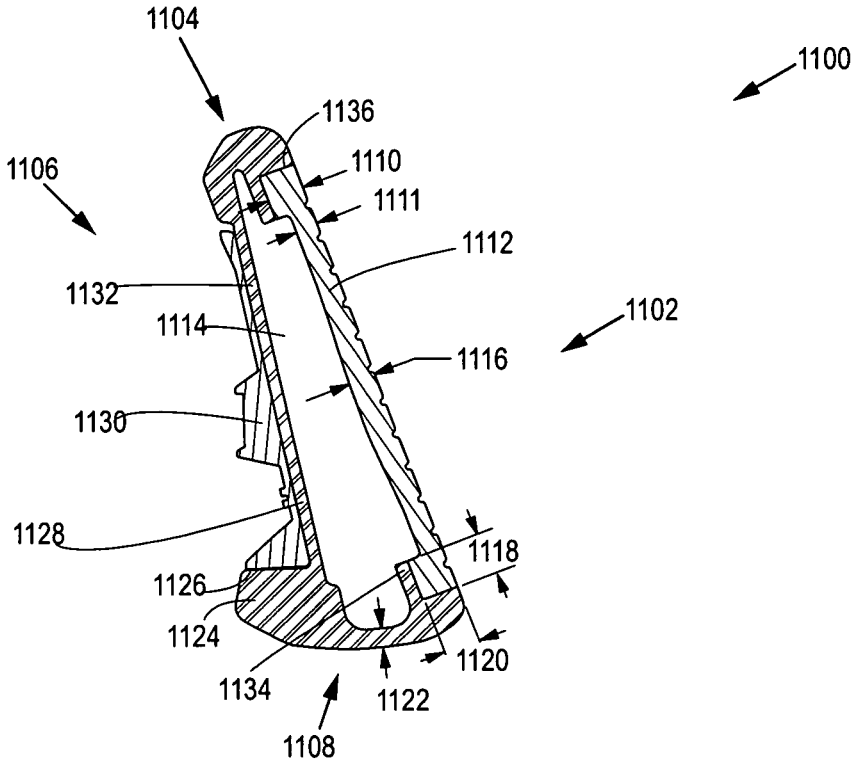
FIG. 11 illustrates a cross-sectional side view of a golf club head taken through an ideal impact location, according to one embodiment.

FIG. 11 illustrates a cross-sectional view according to one exemplary embodiment. The club head 1100 includes a back portion 1106, a top line portion 1104, a front portion 1102 and a sole portion 1108. A composite striking face 1112 is located on the front portion 1102 of the body. In other words, the body includes a front opening that receives the composite striking face 1112. After adhesively attaching the composite face 1112, an interior cavity 1114 is formed. The club head 1100 back portion 1106 further includes a rear wall having an upper rear wall 1132 and a lower rear wall 1128, and a sound and vibration dampening badge 1130. The back portion 1106 also includes a rear protrusion 1124, an upper edge 1126, and a sole thickness 1122.

FIG. 11 further shows the front opening of the club head body having a ledge 1134 extending around an entire periphery of the front opening of the body. It is understood that the ledge 1134 can be continuous or intermittently located around a periphery of the front opening. In one embodiment, the ledge 1134 is perpendicular to a front opening wall 1136. In one embodiment, the ledge extends inwardly toward a center region of the face by a ledge distance 1118 of about 1 mm to about 5 mm, or about 3 mm to about 4 mm. Similarly, the front opening wall 1136 extends perpendicularly away from a plane of the striking face by a depth distance 1120 between about 1 mm to about 5 mm, or between 3 mm to about 4 mm.

In addition the striking insert 1112 includes a varying thickness and a thickened peripheral portion having a third thickness dimension 1110. The composite insert 1112 includes a first thickness 1111 at the thinnest region of the striking insert 1112 and a second thickness 1116 located in a central region of the striking insert 1112. The second thickness 1116 is the thickest dimension within the central region of the striking insert 1112. In one embodiment, the second thickness 1116 is greater than the first thickness 1111 and less than the third thickness 1110 of the peripheral portion. The third thickness 1110 located in a peripheral portion of the striking insert 1112 is greater than both the second thickness 1116 and the first thickness 1111. The peripheral region of the striking insert 1112 having the third thickness 1110 is attached to the ledge 1134.

In one embodiment, the first thickness 1111 can be between about 1.5 mm and about 2.0 mm, with a preferred thickness of about 2 mm or less. The second thickness 1116 can be between about 2 mm and about 3 mm and the third thickness 1110 is between about 3 mm and about 4.5 mm, or preferably about 3.5 mm to about 4.0 mm.

Alternatively, variable thickness configurations or inverted cone configurations can be implemented in the striking face 1112 as discussed in U.S. Pat. Nos. 6,800,038, 6,824,475, 6,904,663, and 6,997,820, all incorporated herein by reference.

In the examples described herein, a composite face insert can have a striking surface area in a range of about 2,700 $mm^2$ to about 5,000 $mm^2$. The unsupported surface area (surface area on the rear surface of the striking insert that is not engaged with a supporting surface) of the composite face insert can be within a range of about 300 $mm^2$ to about 4,000 $mm^2$, or preferably 450 $mm^2$ to about 3,500 $mm^2$. In some embodiments, the unsupported surface area is at least greater than about 2,000 $mm^2$. The unsupported surface area is the portion of the composite insert that is defined by the first thickness 1111 and second thickness 1116 excluding the peripheral portion. The composite face thickness can be within a range of about 1 mm to about 8.0 mm, preferably about 2.5 to about 5 mm. In certain embodiments, the composite face thickness is less than about 4.0 mm. In embodiments having a thickened region, the thickened region surface area can range from about 230 $mm^2$ to about 2,000 $mm^2$.

Figure 12:
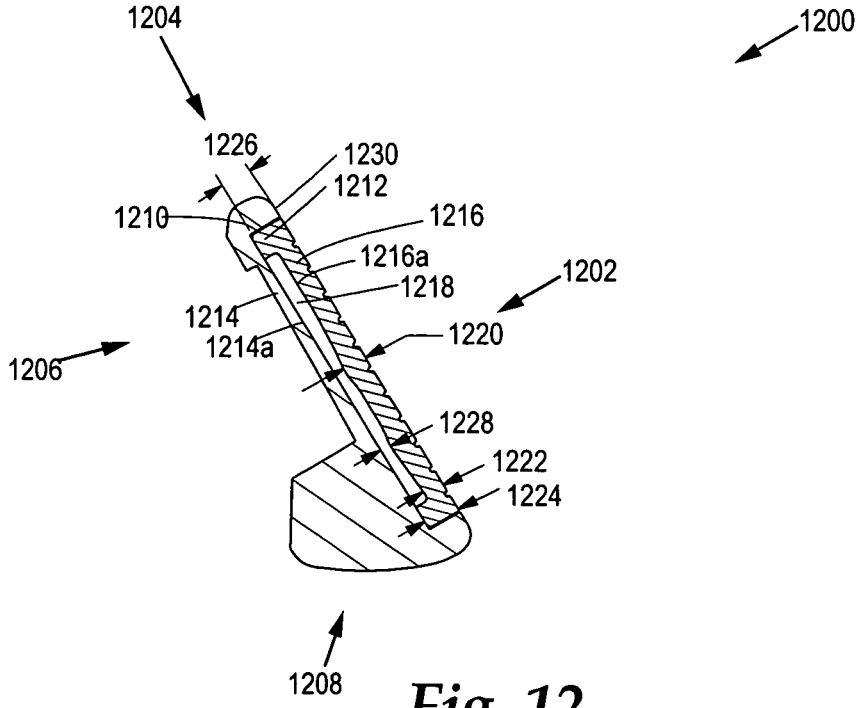
FIG. 12 illustrates a cross-sectional side view of a golf club head taken through an ideal impact location, according to another embodiment.

FIG. 12 illustrates an alternative embodiment of a golf club head 1200 including a front portion 1202, a rear portion 1206, a sole portion 1208 and a top line portion 1204. The club head 1200 includes a front opening located in the front portion 1202. The club head 1200 further includes a composite striking insert 1216, a gap cavity 1218, a back wall 1214, and a peripheral front opening wall 1210. The composite striking insert 1216 includes a first thickness 1222, a second thickness 1220, and a third thickness 1224. The third thickness 1224 corresponds to a thickened end portion 1212 of the striking insert 1216.

The back wall 1214 includes a front engaging surface 1214*a* which provides support for the composite insert 1216 to be adhesively attached. The front engaging surface 1214*a* and the peripheral front opening wall 1210 create the front opening to receive the composite striking insert 1216. The front engaging surface 1214*a* is offset from the front surface 1230 of the club head by an offset distance 1226. The offset distance 1226 can be between about 1 mm and about 5 mm or preferably about 4 mm.

The offset distance 1226 is greater than or equal to the third thickness 1224 of the striking insert 1216 to enable the striking insert 1216 to sit within the front opening. The striking insert 1216 is located within the front opening so that the front striking insert 1216 surface is flush with the front portion surface 1230 of the club head body 1200. The interior gap cavity 1218 is located between the striking insert 1216 and the front engaging surface 1214*a* of the back wall 1214 and can be about 0.1 cc to about 20 cc. In one embodiment, the interior cavity is less than about 10 cc.

The interior cavity is entirely defined and surrounded by the striking insert 1216 and the rear back wall 1214 only. The back wall 1214 is in direct adhesive contact with the striking insert 1216 and supports the striking insert 1216. In other words, the thickened peripheral region 1212 of the striking insert is in direct contact with an interior surface of the back wall 1214.

It is critical that the central region of the striking insert 1216 is not capable of making direct contact with the back wall 1214 upon impact with the golf ball to avoid unwanted sound and unwanted performance effects. Therefore, a critical distance 1228 of about 1 mm or more is maintained between the front engaging surface 1214*a* and a rear surface 1216*a* of the striking insert 1216 at a maximum second thickness 1220 location.

Figure 13A:
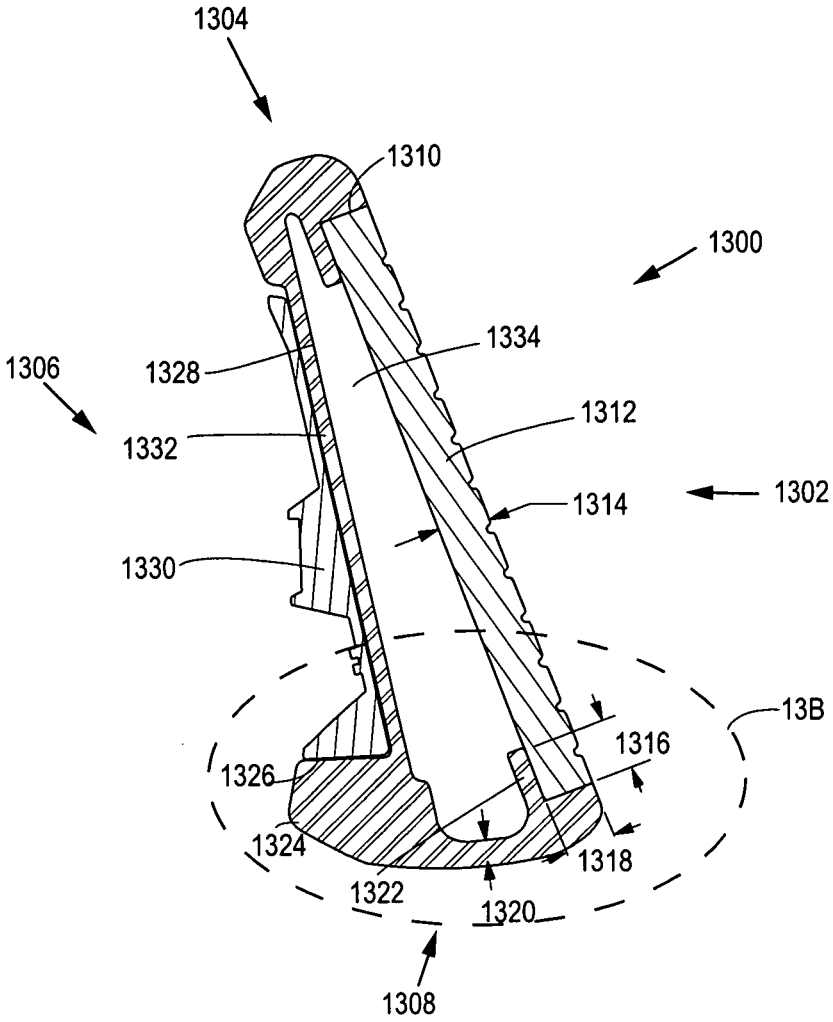
FIG. 13A illustrates a cross-sectional side view of a golf club head taken through an ideal impact location, according to another embodiment.

FIG. 13A illustrates another exemplary embodiment according to another alternative embodiment of a golf club head 1300 including a front portion 1302, a back portion 1306, a sole portion 1308, and a top line portion 1304. The golf club head also includes a badge 1330, back wall portion 1332, an interior back wall surface 1328, a protruding portion 1324, an upper edge 1326, a sole thickness 1320, a ledge 1322, a front opening wall 1310, an interior cavity 1334, and a striking insert 1312. The ledge 1322 extends a distance 1316 inwardly and the front opening wall 1310 also extends a distance 1318 as previously described.

The striking insert material, of the embodiments described herein, are made of the processes and materials described above but can also be a composite material as described in U.S. patent application Ser. No. 10/831,496 (now U.S. Pat. No. 7,140,974), Ser. Nos. 11/642,310, 11/825,138, 11/998,436, 11/823,638, 12/004,386, 12,004,387, 11/960,609, 11/960,610, and 12/156,947, which are incorporated herein by reference in their entirety. All of the composite inserts described herein can be made according to the processes and composite materials described within the above listed patents and patent applications. For example, in one embodiment, a composite face insert material having a fiber areal weight of less than 200 g/m$^2$ is utilized. In another embodiment, a face insert material has a fiber areal weight less than 100 g/m$^2$. In yet other embodiments, the face insert material has a fiber areal weight less than 150 g/m$^2$.

For example, water jet cutting can be utilized to cut the composite face inserts from a sheet of composite material as described in the patents and patent applications incorporated by reference. In addition, the face insert can be formed by CNC cutting Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites). The face insert may also be made of a thermoplastic material, as described herein. In certain embodiments, the composite face inserts described herein are made of a material having a density less than about 1.5 g/cc.

FIG. 13A shows a center cross-sectional view of the striking insert 1312 being a constant thickness 1314 (across the face of the striking insert 1312) and the constant thickness 1314 being between about 3.0 mm to about 5.0 mm, or about 3.5 mm to about 4.5 mm.

Figure 13B:
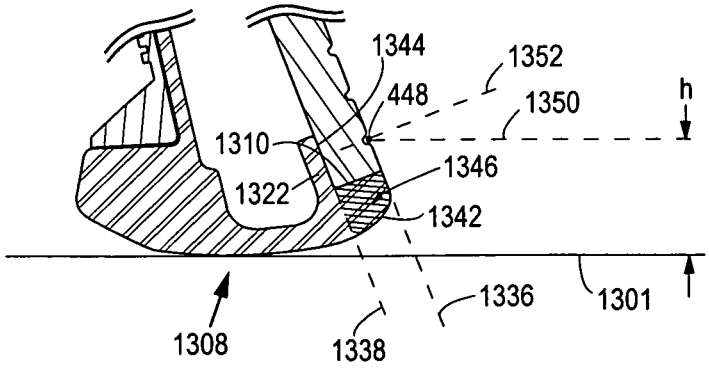
FIG. 13B illustrates a detailed view of a lower leading edge zone.

FIG. 13B is a detailed view of a lower portion of the golf club head 1300 shown in FIG. 13A. FIG. 13B shows a non-undercut design. Specifically, a lower leading edge zone 1346 of the club head body is completely filled with material and does not include an undercut or gap within the lower leading edge zone 1346 in a transition region between the striking surface of the club face and the sole portion 1308.

FIG. 13B shows a club face plane 1336 which contains the striking surface and is co-planar with the striking surface. Furthermore, the ledge 1322 includes a front engaging surface 1344 that is contained within a ledge plane 1338. The club face plane 1336 and the ledge plane 1338 are substantially parallel with respect to one another. A segment 1342 of the sole portion 1308 is located between the face plane 1336 and the ledge plane 1338.

The lower leading edge zone 1346 is defined by the front opening wall 1310, the ledge plane 1338, the club face plane 1336, and the sole portion segment 1342. Within the lower leading edge zone 1346, an undercut or gap is avoided in order to lower the first leading edge groove centerline axis 1348 with respect to the ground 1301. The leading edge groove centerline axis 1348 is defined as the intersection of a bisectional plane 1352 and the club face plane 1336 at the centerline axis 1348 shown in FIG. 13B.

A low leading edge groove centerline axis 1348 is beneficial in allowing a golfer to make engaging contact with a ball sooner upon impact. In addition, a lower leading edge groove centerline axis 1348 may have additional benefits when a golfer mis-hits a ball by improving the quality of contact between the ball and the leading groove or lowest groove.

A horizontal plane 1350 contains the leading edge groove centerline axis 1348 and is parallel with the ground surface 1301. The height distance, h, between the horizontal plane 1350 of the leading edge groove axis 1348 and the ground surface 1301 is between about 4 mm and about 10 mm. In certain embodiments, the height distance, h, is between about 4 mm and about 8 mm or between about 4 mm and about 6 mm.

Figure 14A:
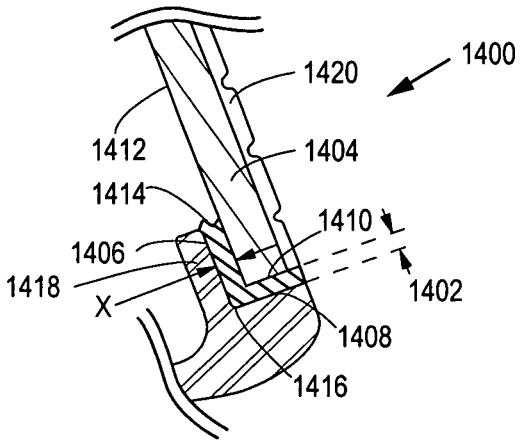
FIG. 14A illustrates an adhesive interface between a face insert and club head body, according to one embodiment.

FIG. 14A illustrates a magnified view 1400 of the junction between a composite face insert 1404 and a ledge 1418, according to one exemplary embodiment. The composite face insert 1404 includes an end wall 1410 and a rear surface wall 1412. The composite face insert 1404 is attached to a front opening wall 1408 and front ledge surface 1406 by an adhesive 1414. The adhesive 1414 is applied over a majority of the interface between the composite face insert 1404 and the front opening wall 1408 and front ledge surface 1406.

The front ledge surface 1406 intersects with the front opening wall 1408 at a rounded corner location 1416. The corner 1416 includes a radius of between about 0.1 mm and about 0.5 mm. In certain embodiments, the radius is at least about 0.30 mm or greater. A larger corner 1416 radius will avoid high stress concentrations that may result in material failure of the ledge 1418 after repeated use.

The rear bond gap distance, x, is located between the front ledge surface 1406 and the rear surface wall 1412. The rear bond gap distance, x, is measured along an axis that is perpendicular to the face plane toward a rear portion of the club head.

The side bond gap distance 1402 between the end wall 1410 and the front opening wall 1408 is between 0.1 mm and 0.5 mm, or about 0.3 mm or less. In one embodiment, the side bond gap distance 1402 and the rear bond gap distance, x, are filled with an adhesive epoxy to attach the composite insert 1404.

In certain embodiments, the rear bond gap distance, x, is equal to or greater than the side bond gap distance 1402. In some embodiments, the rear bond gap distance, x, is in accordance with the following inequality:

$$x \geq 0.2 \text{ mm} \qquad \text{Eq. 1}$$

In the above inequality, the side bond gap distance 1402 is set at a distance of about 0.2 mm. If the rear bond gap distance, x, follows the inequality of Equation 1 described above, the composite face insert 1404 will be securely attached within the front opening. Without maintaining a rear bond gap distance, x, larger than the side bond gap distance 1402, the composite face insert 1404 may become loose after repeated impacts and bending.

FIG. 14A also shows a metallic cap 1420 which can be implemented in any of the embodiments described herein. The metallic cap 1420 can be made of a material having a density less than 9 g/cc or less than 5 g/cc such as a titanium alloy, CP titanium, or a nickel based alloy. In addition, the metallic cap 1420 can be a Ni—Cr or Co—Ni alloy with a chrome plated layer formed by electro-plating or electro-forming.

Figure 14B:
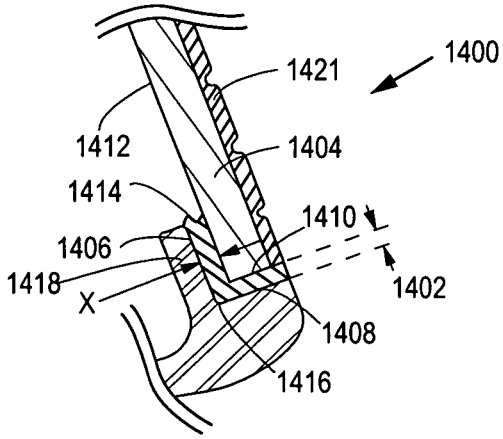
FIG. 14B illustrates an adhesive interface between a face insert and club head body, according to another embodiment.

FIG. 14B further shows another embodiment similar to FIG. 14A except the metallic cap 1420 is replaced by a polymer or polyurethane front layer 1421 having grooves incorporated thereon. The polymer or polyurethane material can be of the type described in U.S. patent application Ser. No. 11/960,609, already incorporated by reference in its entirety. Both the metallic cap 1420 and polymer or polyurethane layer 1421 cover the entire front surface of the face insert 1404.

Figure 15A:
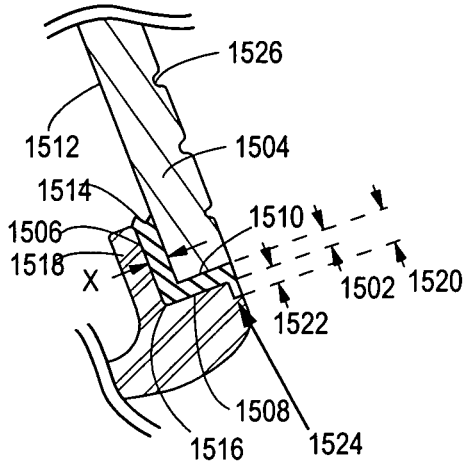
FIG. 15A illustrates an engineering gap between a face insert and a club head body, according to another embodiment.

FIG. 15A illustrates an alternative embodiment 1500 including a composite face insert 1504, a ledge 1518, an end wall 1510, a rear surface wall 1512, a front opening wall 1508, front ledge surface 1506, an adhesive 1514 and a corner 1516, as previously described. The face insert 1504 can include a metallic cap or polyurethane cover as previously described.

However, the embodiment shown in FIG. 15A includes an additional step gap 1522 in addition to a side bond gap distance 1502 or bond gap. The side bond gap distance 1502 and the step gap 1522 (measured along an axis parallel to the face plane) create a total engineering gap 1520. The step gap 1522 is created by a step region 1524. The step region 1524 and step gap 1522 are present about the entire circumference of the front opening wall 1508.

As shown, the side bond gap 1502 and step gap 1522 are filled with the adhesive 1514. The adhesive 1514 in the front portion parallel with the face plane to avoid unwanted bumps or sharp edges on the striking face.

In one embodiment, the total engineering gap 1520 is about 0.5 mm and the side bond gap distance 1502 is about 0.2 mm. As a result, the step gap 1522 is about 0.3 mm. The total engineering gap 1520 can be between about 0.2 mm and about 1 mm or preferably between about 0.2 mm and about 0.8 mm.

The engineering gap 1520 enables the composite face insert 1504 to be attached without maintaining a perfect side bond gap distance 1502 about the entire circumference of the face insert 1504. For example, the embodiment of FIGS. 14A and 14B, without a step gap and engineering gap would require the exact placement of the composite face insert centered within the front opening to achieve a consistent side bond gap distance. An inconsistent side bond gap distance, without an engineering gap, would be clearly seen by the user and would have a negative impact on aesthetic appeal and performance parameters. In other words, the composite face insert without an engineering gap may look off-center to the golfer and negatively impact the golfer's performance.

Figure 15B:
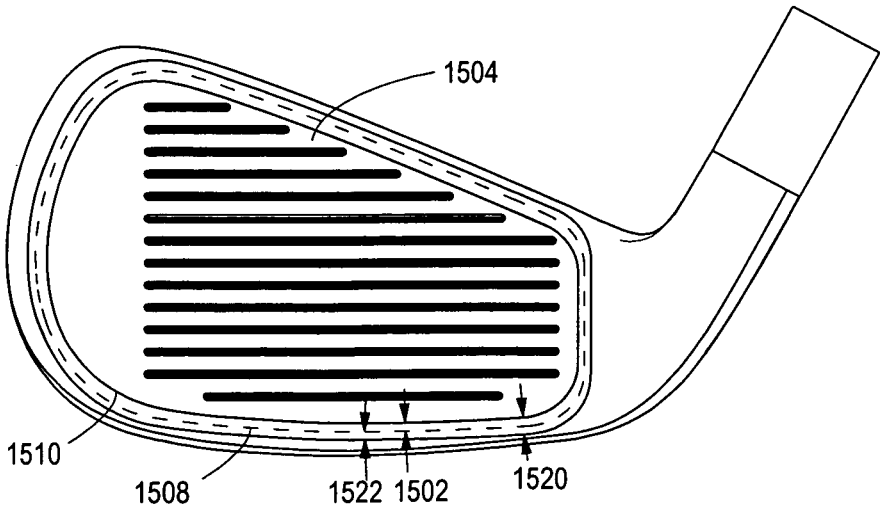
FIG. 15B illustrates a front view of the golf club head shown in FIG. 15A.

FIG. 15B is a front view of a composite face insert with an engineering gap 1520. The side bond gap distance 1502 and step gap 1522 are also shown. Within the face plane, the engineering gap 1520, the side bond gap distance 1502, and the step gap 1522 are measured along an axis that is perpendicular to the end wall 1510 at any given point along the outer peripheral edge of the composite face insert 1504 (within the face plane). The front opening wall 1508 is shown in dashed lines from a front perspective.

The above described engineering gap distance, side bond gap distance and step gap distance can be applied to any of the embodiments described herein. It is understood that the gaps shown in FIG. 15B are exaggerated for clarity.

Figure 16:
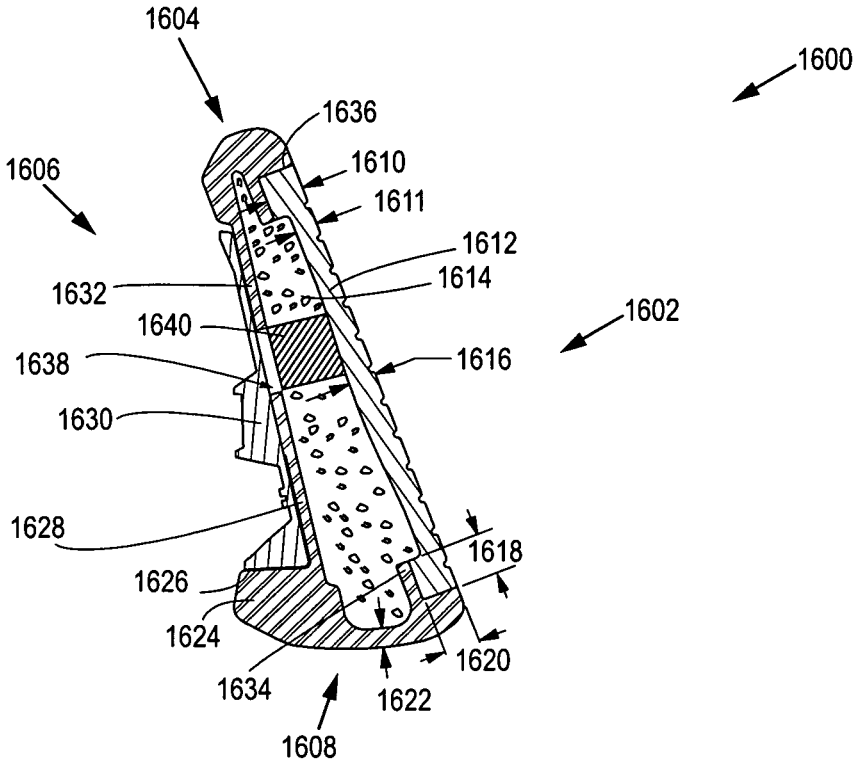
FIG. 16 illustrates a cross-sectional side view of a golf club head taken through an ideal impact location, according to another embodiment.
Figure 17:
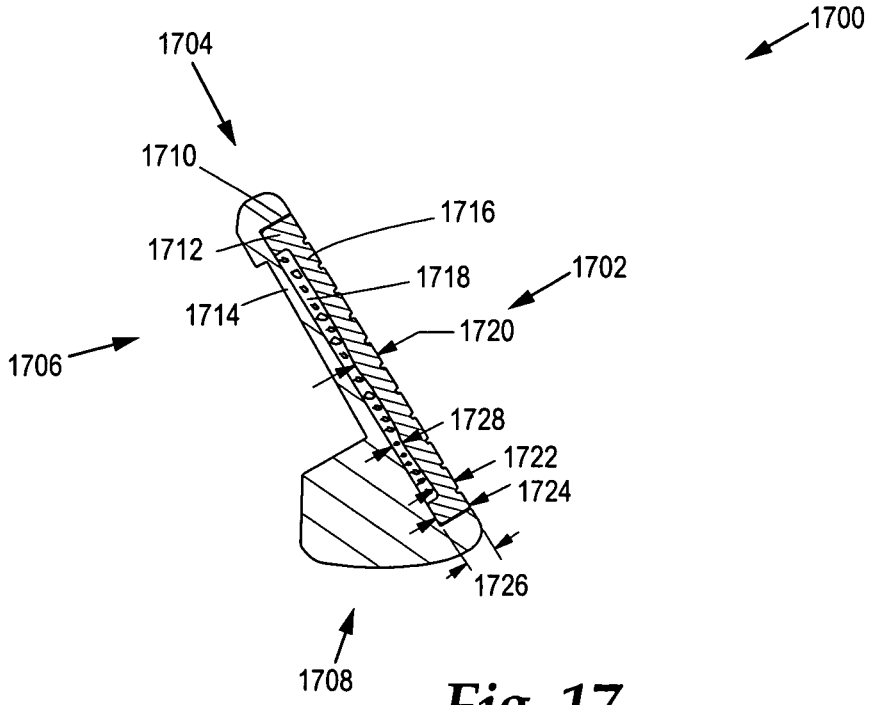
FIG. 17 illustrates a cross-sectional side view of a golf club head taken through an ideal impact location, according to another embodiment.
Figure 18:
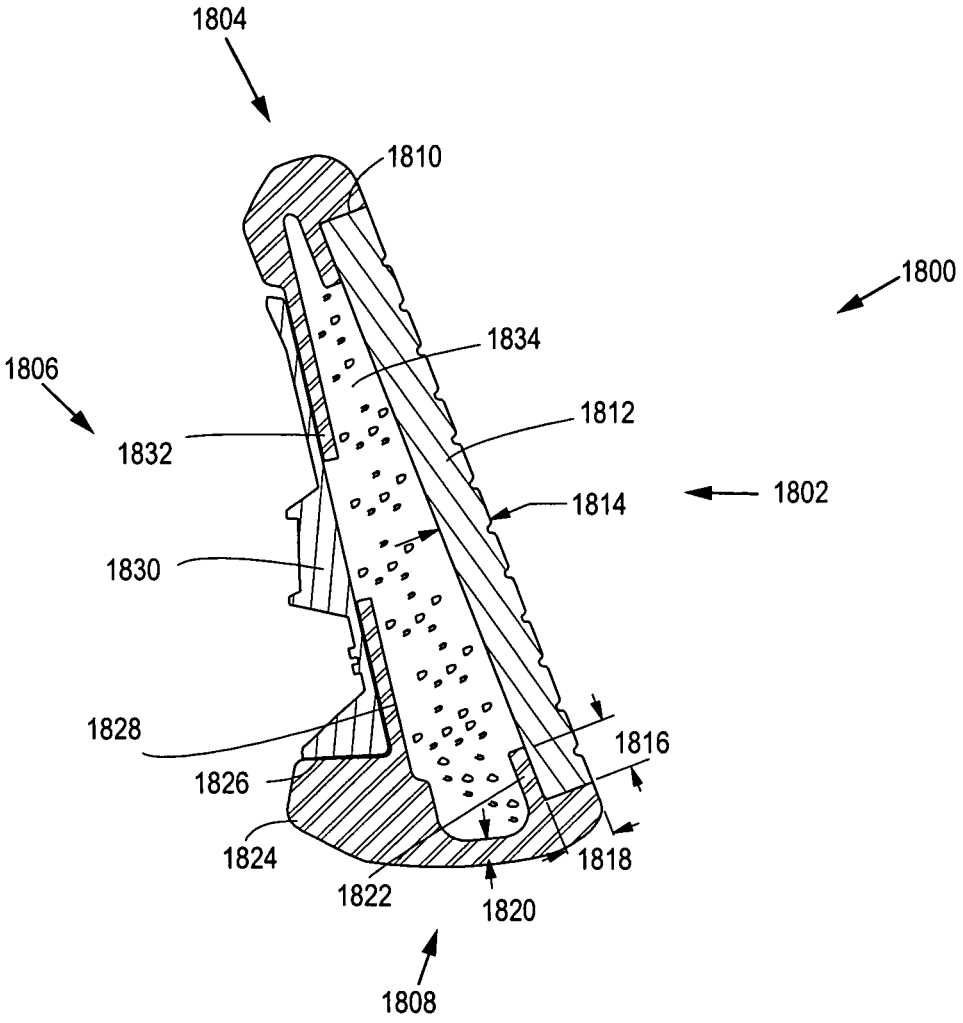
FIG. 18 illustrates a cross-sectional side view of a golf club head taken through an ideal impact location, according to another embodiment.

FIGS. 16-18 illustrate similar embodiments to FIGS. 11-13B, having similar features except the club heads are filled with a filler material.

FIG. 16 illustrates a cross sectional view of an alternative embodiment of a golf club head 1600. The cross section is taken through an ideal striking point in the center of the striking face as previously described.

The club head 1600 includes a front portion 1602, back portion 1606, a top line portion 1604, and a sole portion 1608. The club head 1600 further includes an upper back wall 1632, a lower back wall 1628, a badge 1630, a sole thickness 1622, a rear protrusion 1624, and filler material 1614. The badge 1630 is positioned above an upper edge 1626 and covers an aperture 1638 used for introducing the plug 1640 and filler material 1614 into the interior cavity of the club head 1600. The filler material 1614 and plug 1640 can be of the same configuration, material, and keying design as described in U.S. patent application Ser. No. 12/462,198, incorporated by reference herein, in its entirety.

FIG. 16 further shows a front opening wall 1636, a ledge distance 1618, a depth distance 1620, a first thickness 1611, a second thickness 1616, a third thickness 1610, a ledge 1634, and a composite face insert 1612, previously described.

In one embodiment, the filler material can be an expandable foam such as Expancel® 920 DU 40 which is an acrylic copolymer encapsulating a blowing agent, such as isopentane. A copolymer is greater than about 75 weight percent of the composition and the blowing agent is about 15-20 weight percent. The unexpanded particle size of the filler material can be between about 2 μm and about 90 μm depending on the context.

In one embodiment, the density of the filler material is between about 0.16 g/cc and about 0.19 g/cc. In certain embodiments, the density of the filler material is in the range of about 0.03 g/cc to about 0.2 g/cc, or about 0.04-0.10 g/cc. The density of the filler material impacts the COR, durability, strength, and filling capacity. In general, a lower density material will have less of an impact on the COR of a club head. The filler material can have a hardness range of about 15-85 Shore OO hardness or about 80 Shore OO hardness or less.

In one embodiment, the filler material is subject to heat for expansion of about 150° C.+/−10° C. for about 30 minutes. In some embodiments, the expansion of the filler material can begin at about 125° C. to about 140° C. A maximum expansion temperature range can be between about 160° C. to about 190° C. The temperature at which the expansion of the filler material begins is critical in preventing unwanted expansion after the club head is assembled. For example, a filler material that begins expanding at about 120° C. will not cause unwanted expansion when the club is placed in the trunk of a car (where temperatures can reach up to about 83° C.). Thus, a filler material that has a beginning expansion temperature of greater than about 80° C. is preferred.

Some other examples of materials that can be used as a filler material or plug material include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment the filler material may have a modulus of elasticity ranging from about 0.001 GPa to about 25 GPa, and a durometer ranging from about 5 to about 95 on a Shore D scale. In other examples, gels or liquids can be used, and softer materials which are better characterized on a Shore A or other scale can be used. The Shore D hardness on a polymer is measured in accordance with the ASTM (American Society for Testing and Materials) test D2240.

In certain embodiments, the interior cavity of the club head 1600 can includes the plug 1640 for absorbing vibration. It is understood, that an embodiment without the plug 1640 is within the scope of the present description.

After the plug 1640 is frictionally engaged in a position, the filler material 1614 can be inserted into the cavity. In certain embodiments, the plug 1640 is a polymeric material.

In one embodiment, the plug 1640 material is a urethane or silicone material having a density of about 0.95 g/cc to about 1.75 g/cc, or about 1 g/cc. The plug 1640 can have a hardness of about 10 to about 70 shore A hardness. In certain embodiments, a shore A hardness of about 40 or less is preferred.

The filler material 1614 can be an expanding foam material that is expanded by a certain amount of heat as previously described. The filler material 1614 expands and fills a relatively large volume, greater than the volume occupied by the plug 1640.

In some embodiments, the volume of the cavity is between about 1 cc and about 200 cc, or preferably between about 10 cc and about 20 cc. For the purposes of measuring the cavity volume herein, the aperture 1638 is assumed to be removed from the back wall 1632 and an imaginary continuous back wall or substantially planar back wall is utilized to calculate the cavity volume.

In some embodiments, the filler material 1614 occupies about 50% to about 99% of the total club head cavity volume while the plug 1640 occupies between about 0% to about 20% of the total cavity volume. In specific embodiments, the plug 1640 occupies between about 0.1 cc and 1 cc with the remainder of the cavity volume being filled by the filler material 1614. It is understood that any of the embodiments described herein can be provided without a plug and filler material.

In order to achieve a desirable CG location, the filler material 1614 and plug 1640 must be lightweight. In certain embodiments, the total mass of the filler material 1614 and plug 1640 is less than about 5 g or between about 2 g and about 4 g. In one embodiment, the total weight of the filler material 1614 and the plug 1640 is 10 g or less or about 3 g or less. In certain embodiments, the total weight of the filler material 714 and plug 1640 is less than 2% of the total weight of the club head 1600 (excluding any badges, filler material/plug, and ferrule ring). In other embodiments, the total weight of the filler material 714 and plug 1640 is less than about 10% of the total weight of the club head 1600.

In some embodiments, the total weight of the filler material 1614 and plug 1640 is between about 1% and about 5% of the total weight of the club head (excluding the badges, filler material/plug, and ferrule ring). Thus, a desirable CG location is still attainable while improving the sound and feel of the golf club head. In certain embodiments, the plug 1640 can weigh about 0.5 g to about 1 g and the filler material 1614 can weigh about 5 grams or less. In some embodiments, the plug 1640 weighs about 0.7 g or less. In other embodiments, the plug 1640 can be equal to or heavier than the total filler material weight.

In yet other embodiments, the filler material 1614 and the plug 1640 have a combined weight of less than 20% of the total club head weight (excluding badges, filler material/plug, and ferrule ring). In one embodiment, the combined weight of the filler material 1614 and plug 1640 is less than 5%.

FIG. 17 illustrates an alternative embodiment of a golf club head 1700 including a front portion 1702, a rear portion 1706, a sole portion 1708 and a top line portion 1704. The club head 1700 includes a front opening located in the front portion 1702. The club head 1700 further includes a composite striking insert 1716, filler material 1718, a back wall 1714, and a peripheral front opening wall 1710. It is possible to include a plug, badge, and aperture as described above. The striking insert 1716 includes a first thickness 1722, a second thickness 1720, and a third thickness 1724. A critical distance 1728 having dimensions described above is also present. The peripheral region 1712 is in contact with the front surface of the rear wall 1714. The front surface of the rear wall 1714 is located at an offset distance 1726, previously described.

The filler material 1718 can be of the type already described above or can be a thermoplastic elastomer having a density of about 0.9 g/cc to about 1.20 g/cc.

FIG. 18 shows a top line portion 1804, back portion 1806, front portion 1802, sole portion 1808, back wall portion 1832, badge 1830, interior back wall surface 1828, upper edge 1826, protruding portion 1824, ledge 1822, sole thickness 1820, offset distance 1818, ledge distance 1816, constant face thickness 1814, front opening wall 1810, and filler material 1834, as previously described.

In certain embodiments, the badges and composite face inserts, described herein, can be adhesively attached with epoxy or any known adhesive. For example, an epoxy such as 3M® DP460 can be used. It is possible for the badge 1830 to be mechanically attached to the back portion 1806 of the club head 1800.

After the hollow iron 1800 is filled with the filler material 1834, the badge 1830 is adhesively or mechanically attached to the back wall 1832 to cover or occlude the aperture to prevent filler material from leaving the cavity and also to achieve a desired aesthetic and while creating further dampening.

In some embodiments, the COR is greater than about 0.790. Preferably, the COR is at least 0.80 as measured according to the USGA Rules of Golf based on a 160 ft./s ball speed test and the USGA calibration plate. The COR can even be as high as 0.83.

In one embodiment, the body portion is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), or austenitic stainless steel (e.g., 304, N50, or N60 stainless steel, 410 stainless steel) can be used.

The components of the described components disclosed in the present specification can be formed from any of various suitable metals or metal alloys.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

The body portion can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

Figure 19:
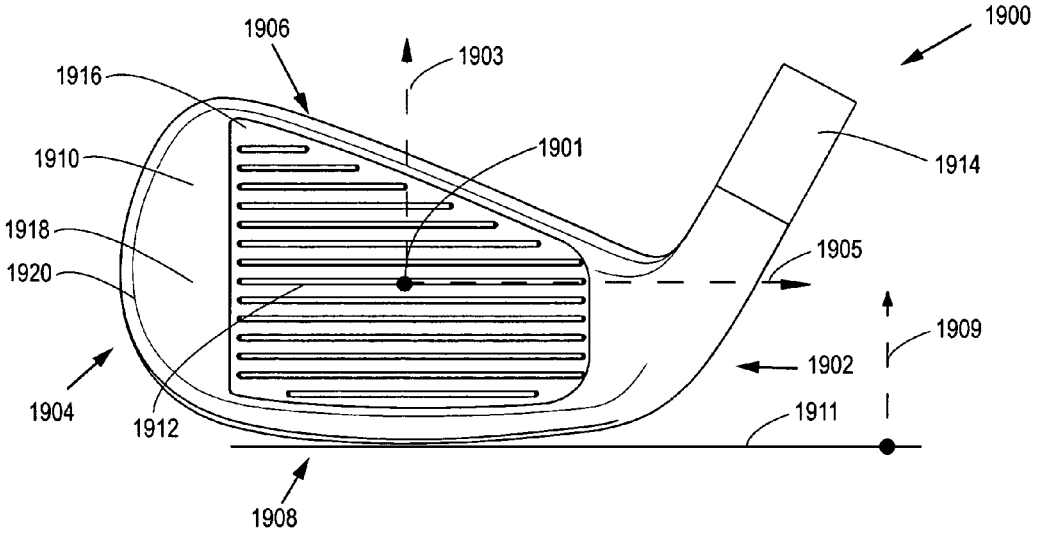
FIG. 19 illustrates a front view of a golf club head in an address position, according to another embodiment.

FIG. 19 shows a golf club head 1900 having a heel 1902, toe portion 1904, sole portion 1908, top line portion 1906, striking face 1910, scoreline grooves 1912, a center point 1901, a CG x-axis 1905, a CG z-axis 1903, a CG z-up axis, a ground plane 1911 as previously described in FIG. 10A.

However, the composite face insert 1916 does not extend across the striking surface to a toe portion 1904 edge 1920 as shown in FIG. 19. The composite face insert 1916 occupies about 50% to about 90% of the front striking surface plane. Subsequently, about 50% to about 10% of the front striking surface plane is comprised of the metallic material similar to the golf club head body.

Including a smaller percentage of composite face insert 1916 striking surface area can result in a significant reduction in manufacturing cost and composite material savings.

At least one advantage of the present invention is that a lightweight composite face insert will provide an improved CG club head location.

In addition, a certain engineering gap can be utilized to reduce the manufacturing time and expense associated with perfectly centering a composite face insert in a front opening of the golf club head.

At least another advantage of the embodiments described above, is that a rear back wall and badge can act to create an enclosed cavity behind the composite face so that the ledge and adhesive material used to bond the face insert to the club body is not visible to the user.

At least another advantage of the embodiments described is that a lightweight filler material arrangement is created allowing the center of gravity of the hollow iron construction to remain low while improving the sound and feel of the club during use.

The embodiments described herein conform with the USGA (United States Golf Association) Rules of Golf and Appendix II, 5c related to the Determination of Groove Conformance (issued in August 2008). For example, clubs having a loft of 25 degrees or higher meets the groove width, groove depth, groove separation, groove consistency, area limitations, and edge radius requirements set forth by the USGA. In the embodiments described herein, less than 50% of measured values of Area/(Width+Separation) are greater than 0.0030 $in^2$/in and no single measured value of Area/(Width+Separation) value for any single groove is greater than 0.0032 $in^2$/in.

With respect to a groove edge radius, the groove edges are in the form of a radius having an effective radius not less than 0.010" as described by the two circles method described in the USGA rules. In addition, the effective radius is not greater than 0.020". In the embodiments described, less than 50% of the upper groove edges or lower groove edges fails the two circles method subject to a 10 degree angular allowance as described in the USGA rules. No single groove edge protrudes more than 0.0003" outside the outer circle.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. An iron-type golf club head comprising:

a body having a heel portion, a sole portion, a toe portion, a top-line portion, a front portion, a rear portion, and a striking face;

a cavity being defined by at least a rear surface of the striking face, an interior rear wall surface arranged behind the rear surface of the striking face, and the sole portion;

a composite face insert comprising prepreg plies having a fiber areal weight of less than 200 $g/m^2$, the face insert being attached at a front opening of the body and enclosing the front opening of the body, wherein the thickness of the prepreg plies is within a range of about 1 mm to about 8 mm; and wherein the composite face insert includes a front striking surface having a polyurethane layer that is located on a majority of the front striking surface of the composite face insert, wherein the body includes a lower leading edge zone that is entirely filled with material.

2. The iron-type golf club head of claim 1, wherein the interior rear wall in the rear portion encloses a substantial portion of the rear portion to create a substantially enclosed cavity.

3. The iron-type golf club head of claim 1, wherein the composite face insert includes a front striking surface having a metallic cap layer that is located on a majority of the front striking surface of the composite face insert.

4. The iron-type golf club head of claim 1, wherein a height distance between a horizontal plane of the leading edge groove location and the ground surface is between about 4 mm and about 10 mm.

5. The iron-type golf club head of claim 1, wherein a height distance between a horizontal plane of the leading edge groove location and the ground surface is between about 2 mm and about 6 mm.

6. The iron-type golf club head of claim 1, wherein the composite face insert includes a thickened central region.

7. The iron-type golf club head of claim 1, wherein the coefficient of restitution is at least 0.79.

8. The iron-type golf club head of claim 1, wherein at least one plug is positioned to be in contact with at least a portion of the face insert.

9. The iron-type golf club head of claim 1, wherein at least one plug contacts the inner back wall surface.

10. The iron-type golf club head of claim 1, further comprising an aperture into the enclosed cavity, the aperture being configured to allow the cavity to be filled with a filler material.

11. The iron-type golf club head of claim 10, wherein the filler material is an expanding foam material having a density between about 0.03 g/cc and about 0.2 g/cc.

12. The iron-type golf club head of claim 1, wherein a rear bond gap distance is equal to or greater than a side bond gap distance.

13. The iron-type golf club head of claim 1, wherein a rear bond gap distance is greater than or equal to 0.2 mm.

14. The iron-type golf club head of claim 1, wherein a front ledge surface and front opening wall intersect at a rounded corner location.

15. The iron-type golf club head of claim 1, wherein at least one scoreline is molded into the composite face insert.

16. The iron-type golf club head of claim 1, wherein the composite face insert is formed by water jet cutting.

17. The iron-type golf club head of claim 1, wherein the composite face insert includes prepreg plies having a fiber areal weight of less than 150 $g/m^2$.

18. An iron-type golf club head comprising:

a body having a heel portion, a sole portion, a toe portion, a top-line portion, a front portion, a rear portion, and a striking face;

a cavity being defined by at least a rear surface of the striking face, an interior rear wall surface substantially facing the rear surface of the striking face, and the sole portion;

a composite face insert comprising prepreg plies having a fiber areal weight less than 100 $g/m^2$, the face insert being attached at a front opening of the body and enclosing the front opening of the body, wherein the thickness of the prepreg plies is within a range of about 1 mm to about 8 mm, the golf club head having a coefficient of restitution of at least 0.79.

* * * * *